US006371771B1

(12) United States Patent
Fan

(10) Patent No.: US 6,371,771 B1
(45) Date of Patent: Apr. 16, 2002

(54) UNIVERSAL SERIAL BUS CONNECTOR WITH POWER TRANSMISSION FUNCTION

(75) Inventor: Chia Hao Fan, Shu-Lin (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,421

(22) Filed: Dec. 28, 2000

(51) Int. Cl.[7] ..... H01R 13/648
(52) U.S. Cl. ..... 439/79; 439/660; 439/607
(58) Field of Search ..... 439/607–610, 439/660, 79

(56) References Cited

U.S. PATENT DOCUMENTS 4,602,832 A * 7/1986 Cunningham et al. ..... 439/579
4,993,968 A * 2/1991 Guletsky et al. ..... 439/579
5,046,966 A * 9/1991 Snyder et al. ..... 439/579
5,241,135 A * 8/1993 Fetzer ..... 439/579
5,735,695 A * 4/1998 Heinrich ..... 439/581
6,007,347 A * 12/1999 Keldsen et al. ..... 439/581

* cited by examiner

*Primary Examiner*—Gary Paumen
*Assistant Examiner*—James R Harvey
(74) *Attorney, Agent, or Firm*—Wei Te Chung

(57) ABSTRACT

An electrical connector (1) includes an insulative housing (20), a plurality of first electrical terminals (30), at least one second electrical terminal (40) and a shielding shell 50. The first and second electrical terminals are respectively assembled in the insulative housing of the electrical connector and are electrically engageable with corresponding terminals of a complementary connector. The second electrical terminal and its corresponding terminal of the complementary connector are specially designed for transmitting power needed by peripheral electronic devices.

1 Claim, 3 Drawing Sheets

UNIVERSAL SERIAL BUS CONNECTOR WITH POWER TRANSMISSION FUNCTION

BACKGROUND OF THE INVENTION

1. Field of the Invention

The present invention relates to an electrical connector, and particularly to a Universal Serial Bus connector with a relatively big current power transmission function.

2. Description of the Related Art

As notebook computers are made smaller and smaller, available space in each notebook computer for receiving necessary peripheral devices, such as hard disc driver (HDD) or compact disk read-only-memory (CD ROM), becomes limited. Therefore, these peripheral devices are being made to operate outside the notebook computer, so that, when in use they are connected to the notebook computer by a cable connector assembly. Many of the notebook and peripheral device cable interfaces use universal serial bus connectors and a separate power jack is used for supplying power from the notebook computer to each peripheral device.

The present usage has the disadvantage that it needs two different types of connectors (i.e., USB and power jack) to operate each peripheral device, which is not only costly, but also uses more space to accommodate the connectors. Furthermore, a user has to plug in cables to both a USB connector and a power jack and this is inconvenient.

Therefore, a USB connector with a power transmission function is needed to overcome the disadvantages of the conventional art.

SUMMARY OF THE INVENTION

A major object of the present invention is to provide an electrical connector which has four first electrical terminals used as a signal interface with a peripheral device and a second electrical terminal used for transmitting power to the peripheral device, which is connected to a notebook computer.

An electrical connector in accordance with the present invention comprises an insulative housing, four first electrical terminals, a second electrical terminal and a shielding shell. The insulative housing comprises a base portion and an island portion protruding perpendicularly and forwardly from the base portion. The first electrical terminals extend from a rear of the base portion into a plurality of parallel terminal receiving passageways defined in the island portion. The second electrical terminal is assembled from a bottom of the base portion and has a spring arm extending from the base portion toward the island portion. The first and second electrical terminals are separated from each other and are electrically engageable with corresponding electrical terminals of a complementary electrical connector.

Other objects, advantages and novel features of the invention will become more apparent from the following detailed descriptionof the present embodiment when taken in conjunction with the accompanying drawings.

DETAILED DESCRIPTION OF THE INVENTION

Figure 1:
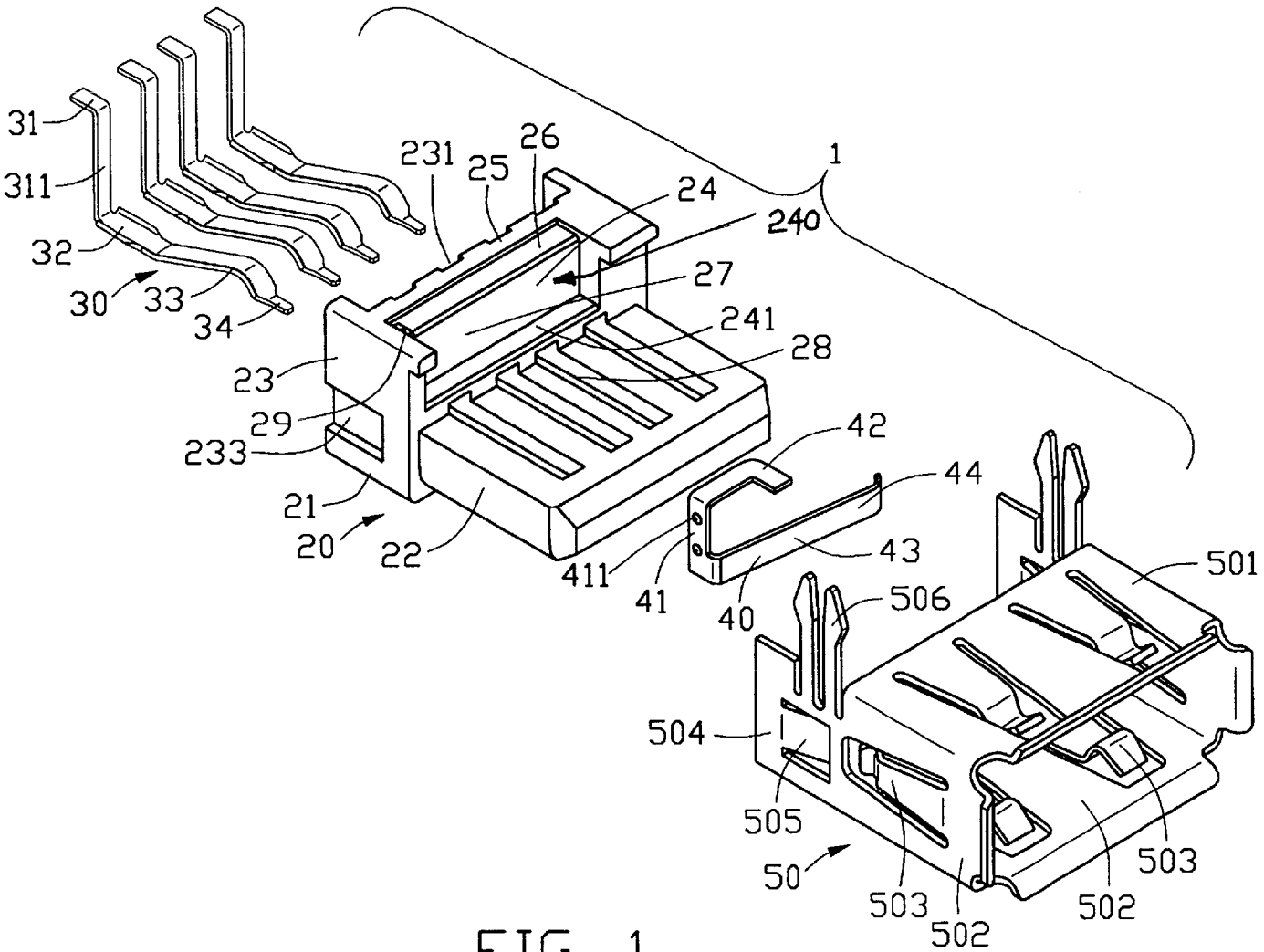
FIG. 1 is an exploded view of an electrical connector in accordance with the present invention, wherein the electrical connector is at an inverted orientation from its normal use.

Referring to FIG. 1, an electrical connector 1 in accordance with the present invention is a Universal Serial Bus (USB) connector which is modified to include a relatively high current-carrying power transmission function. The connector 1 comprises an insulative housing 20, four first electrical terminals 30, a second electrical terminal 40 and a conductive shielding shell 50.

The insulative housing 20 comprises a base portion 21 and an island portion 22 protruding perpendicularly and forwardly from the base portion 21. The base portion 21 comprises a first retention section 23 and a second retention section 24. The first retention section 23 defines a mounting surface 25 on a bottom thereof and a plurality of grooves 231 vertically extending on a rear thereof. The second retention section 24 defines a slot 29 between one end thereof and a side portion of the first retention section 23 and forms an engaging surface 26 extending parallel to and a little above the mounting surface 25. The second retention section 24 defines a recess 240 with a wall 27 facing forwardly and perpendicular to the engaging surface 26. A step section 241 under the recess 240 is formed between the wall 27 and the island portion 22. The island portion 22 defines a plurality of parallel, longitudinally extending terminal receiving passageways 28 which extend through the base portion 21 and are in communication with the grooves 231.

The first electrical terminals 30 each comprise a mounting tail 31, a foot portion 311 perpendicularly and upwardly extending from the mounting tail 31, a fixing portion 32 extending perpendicularly from an upper end of the foot portion 311 and a curved first contacting portion 33 extending from the fixing portion 32 opposite to the foot portion 311. A free end 34 is formed at a distal end of the first contacting portion 33.

The second electrical terminal 40 comprises a rectangular fixing portion 41, a mounting tail 42 perpendicularly extending from a lower end of the fixing portion 41 and a spring arm 43 extending from an upper side edge of the fixing portion 41. The mounting tail 42 is L-shaped and the spring arm 43 includes a curved second contacting portion 44 adjacent to a distal free end thereof.

The shielding shell 50 has a generally rectangular hollow body 501 for shielding the first contacting portions 33 of the first electrical terminals 30 and the second contacting portion 44 of the second electrical terminal 40. The body 501 has four side walls 502 each forming at least one tongue 503 thereon for engaging a shielding shell of a complementary connector. An extension 504 is formed on a rear end of each lateral side wall of the body 501. A tab 505 inwardly projects from each extension 504 for fitting into a recess 233 defined in each lateral side of the first retention section 23 to securely assemble the shielding shell 50 and the housing 20 together. A board lock 506 extends downwardly from a lower portion of each extension 504 for having an interferential engagement with a hole defined in a printed circuit board (not shown) thereby fixedly mounting the connector 1 to the printed circuit board.

Figure 2:
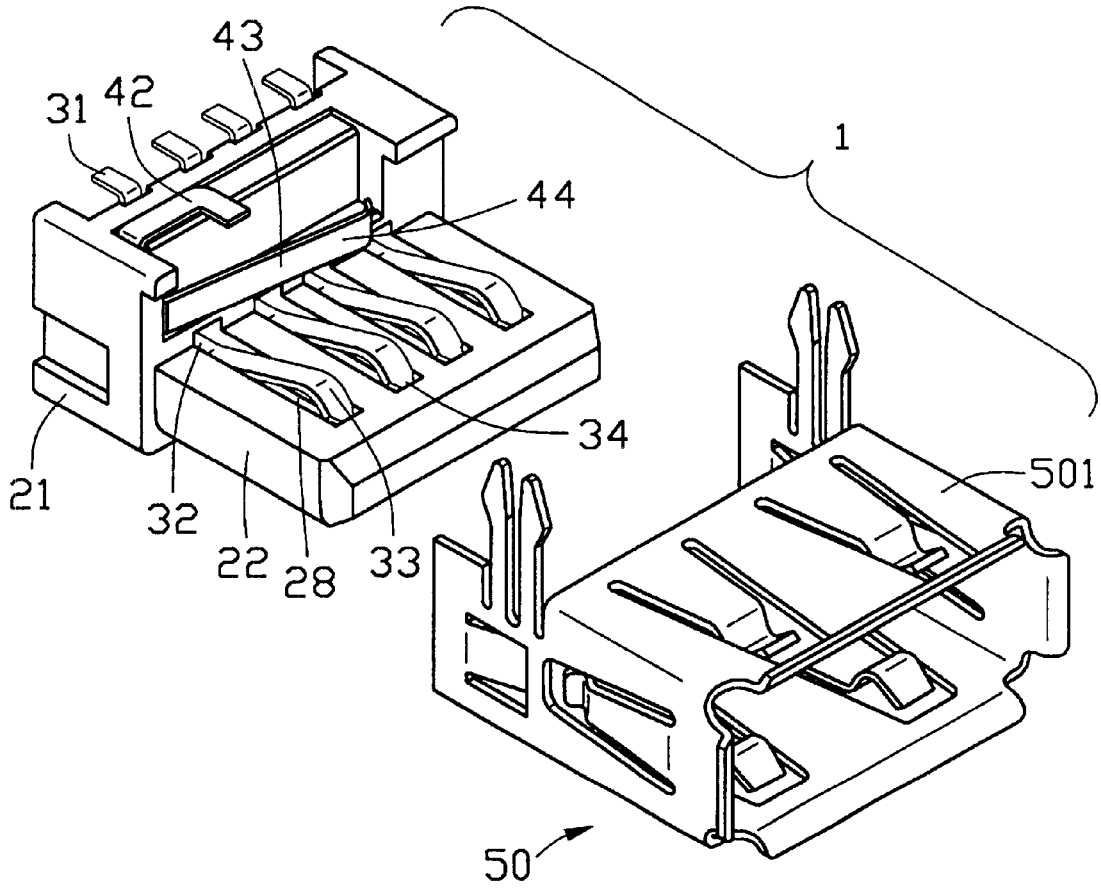
FIG. 2 is a partially assembled view of the electrical connector of FIG. 1.
Figure 3:
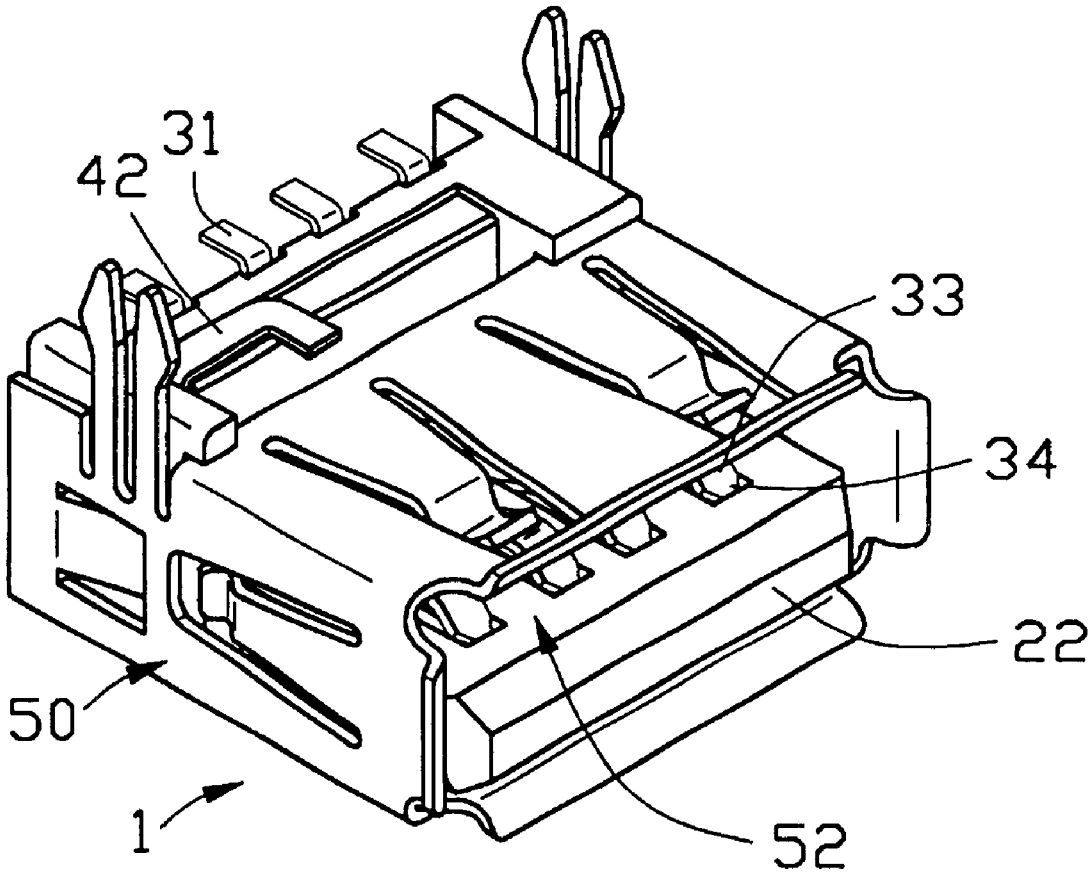
FIG. 3 is a completely assembled perspective view of the electrical connector of FIG. 1.

Referring now to FIGS. 2 and 3, in assembly, the first electrical terminals 30 are inserted from the rear of the base portion 21 into the terminal receiving passageways 28. The foot portions 311 depend downwardly through the grooves 231 and the mounting tails 31 are flush with the mounting surface 25. The fixing portions 32 reliably fix the first electrical terminals 30 in the insulative housing 20. The first contacting portions 33 protrude downwardly beyond a bottom face of the island portion 22 while the free ends 34 are embedded in the island portion 22. The second electrical terminal 40 is inserted from the bottom of the base portion 21. The fixing portion 41 is received in the slot 29 and is partially supported by the step section 241. Two buds 411 are formed on the fixing portion 41. The buds 411 have an interferential engagement with the housing 20 when the fixing portion 41 is inserted into the slot 29 thereby securely mounting the second electrical terminal 40 to the housing 20. The spring arm 43 extends outwardly and transversely from the slot 29. The mounting tail 42 abuts the engaging surface 26 and is flush with the mounting surface 25 and the mounting tails 31 of the first electrical terminals 30. The mounting tail 42 of the second electrical terminal 40 extends in a direction opposite to the mounting tails 31 of the first electrical terminals 30. The shielding shell 50 is then assembled to the housing 20 to enclose the insulative housing 20 and the first and second electrical terminals 30, 40.

In use, when a complementary electrical connector (not shown) is inserted into a receiving cavity 52 of the electrical connector 1, the first and second electrical terminals 30, 40 are electrically connected with corresponding terminals (not shown) of the complementary connector. The second electrical terminal 40 and its corresponding terminal are specially designed for transmitting power without interfering with the first electrical terminals 30 and their corresponding terminals for transmitting signals. When an electrical connector (not shown) with only terminals corresponding to the first electrical terminals 30 of the electrical connector 1 is mated with the electrical connector 1, the second electrical terminal 40 of the electrical connector 1 is not in use and does not transmit power.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base portion and an island portion protruding forwardly from the base portion, the island portion defining a plurality of terminal receiving passageways extending through the base portion;

a plurality of first electrical terminals for signal transmission being received in the terminal receiving passageways; and at least one second electrical terminal for power transmission being retained to the base portion of the insulative housing and being separated from the first electrical terminals, the second electrical terminal comprising a spring arm extending from the base portion toward the island portion;

wherein a number of the solder pads in the first row is equal to that of the solder pads in the second row and is equal to that of the wires of the coaxial cable;

wherein the printed circuit board defines a row of slots extending therethrough, a number of the slots being less than that of the solder pads in any one of the first and second rows so that each slot receives more than one wire therethrough;

wherein the first and second rows of solder pads are parallel to each other and the row of slots are defined between and parallel to the first and second rows of solder pads.

* * * * *